US010370076B2

(12) United States Patent
Wireman

(10) Patent No.: US 10,370,076 B2
(45) Date of Patent: Aug. 6, 2019

(54) STEERING APPARATUS PROVIDING VARIABLE STEERING RATIOS

(71) Applicant: Justin M. Wireman, Comstock Park, MI (US)

(72) Inventor: Justin M. Wireman, Comstock Park, MI (US)

(73) Assignee: BRUNSWICK CORPORATION, Lake Forest, IL (US)

( * ) Notice: Subject to any disclaimer, the term of this patent is extended or adjusted under 35 U.S.C. 154(b) by 0 days.

(21) Appl. No.: 14/617,466

(22) Filed: Feb. 9, 2015

(65) Prior Publication Data

US 2015/0151824 A1 Jun. 4, 2015

Related U.S. Application Data

(63) Continuation of application No. 13/829,179, filed on Mar. 14, 2013, now Pat. No. 8,991,280.

(51) Int. Cl.

| | |
|---|---|
| ***B63H 25/10*** | (2006.01) |
| ***B63H 20/00*** | (2006.01) |
| ***B63H 20/12*** | (2006.01) |

(52) U.S. Cl.

CPC ..... *B63H 21/265* (2013.01); *B63H 20/007* (2013.01); *B63H 20/12* (2013.01); *B63H 25/10* (2013.01); *Y10T 74/20564* (2015.01)

(58) Field of Classification Search

CPC .... B63H 20/007; B63H 21/265; B63H 20/12; B63H 25/08; B63H 25/10; F02B 61/045

See application file for complete search history.

(56) References Cited

U.S. PATENT DOCUMENTS

| | | | | |
|---|---|---|---|---|
| 2,865,217 A | | 12/1958 | Bishop | |
| 3,203,270 A | | 8/1965 | Booth | |
| 3,403,578 A | * | 10/1968 | Morse | B63H 21/265 114/160 |
| 3,823,617 A | | 7/1974 | Infanger et al. | |
| 3,832,967 A | * | 9/1974 | Waner | B63H 25/10 114/144 R |
| 4,040,375 A | * | 8/1977 | Atkins | B63H 25/10 114/144 R |
| 4,526,050 A | * | 7/1985 | Johnson | F16H 19/0672 74/506 |
| 4,820,208 A | | 4/1989 | Phillips, Sr. | |
| 5,018,469 A | | 5/1991 | Carlson | |
| 5,112,256 A | | 5/1992 | Clement | |
| 5,378,179 A | | 1/1995 | Riggle | |

(Continued)

FOREIGN PATENT DOCUMENTS

| | | | |
|---|---|---|---|
| JP | 2007153004 A | * | 6/2007 |
| JP | 2011093404 A | * | 5/2011 |

OTHER PUBLICATIONS

Sai et al., Cable Type Steering Device, Jun. 21, 2007, JPO, JP 2007-153004 A, English Abstract.*

(Continued)

*Primary Examiner* — James A English
(74) *Attorney, Agent, or Firm* — Hanley, Flight & Zimmerman, LLC

(57) ABSTRACT

Steering apparatus having variable steering ratios are disclosed herein. An apparatus disclosed herein includes a steering drum having an oblong shaped cross section and a cable wrapped around an outer surface of the steering drum.

21 Claims, 8 Drawing Sheets

(56) References Cited

U.S. PATENT DOCUMENTS

| | | | | |
|---|---|---|---|---|
| 6,116,371 | A * | 9/2000 | Suyama | B62D 1/163 180/400 |
| 6,126,497 | A | 10/2000 | Stockton | |
| 6,419,043 | B1 * | 7/2002 | Duval | B62D 1/163 180/444 |
| 6,546,889 | B1 | 4/2003 | Jacob et al. | |
| 6,877,583 | B2 * | 4/2005 | Shimizu | B62D 1/163 180/421 |
| 8,991,280 | B2 | 3/2015 | Wireman | |
| 2003/0024456 | A1 * | 2/2003 | Swetish | B63H 20/007 114/144 R |
| 2005/0072621 | A1 * | 4/2005 | Hara | B62D 1/163 180/444 |
| 2008/0066974 | A1 * | 3/2008 | Pearlman | A61G 5/043 180/22 |
| 2010/0273367 | A1 * | 10/2010 | Mynster | B63H 20/12 440/53 |
| 2014/0260764 | A1 | 9/2014 | Wireman | |

OTHER PUBLICATIONS

Sai et al., Cable Type Steering Device, Jun. 21, 2007, JPO, JP 2007-153004 A, Machine Translation of Description.*

Yoshihide Sekiya, Steering System, May 12, 2011, JPO, JP 2011-093404 A, English Abstract.*

Yoshihide Sekiya, Steering System, May 12, 2011, JPO, JP 2011-093404 A, Machine Translation of Description.*

United States Patent and Trademark Office, "Non-final Office Action," issued in connection with U.S. Appl. No. 13/829,179, dated Jun. 30, 2014, 20 pages.

United States Patent and Trademark Office, "Final Office Action," issued in connection with U.S. Appl. No. 13/829,179, dated Oct. 7, 2014, 15 pages.

United States Patent and Trademark Office, "Notice of Allowance and Fee(s) Due" issued in connection with U.S. Appl. No. 13/829,179, dated Nov. 14, 2014, 21 pages.

* cited by examiner

STEERING APPARATUS PROVIDING VARIABLE STEERING RATIOS

RELATED APPLICATION

This patent application arises from a continuation of U.S. application Ser. No. 13/829,179, which was filed on Mar. 14, 2013 and is hereby incorporated by reference in its entirety.

FIELD OF THE DISCLOSURE

This patent relates generally to steering apparatus and, more specifically, to steering apparatus providing variable steering ratios.

BACKGROUND

Boats and/or other marine crafts often employ a propulsion unit or propeller to propel the marine craft. The propulsion unit or propeller is also used to steer the marine craft. To steer the marine craft, a propulsion unit or propeller is often rotated via a steering drum or apparatus. To control the position of the steering apparatus and, thus, the propulsion unit or the propeller, the marine craft often employs a controller. However, the steering apparatus and controller often provide a uniform or constant steering ratio over a rotational range of the steering apparatus. However, such known uniform or constant steering ratios provide a steering ratio for controlling the forward or rearward movement of the marine craft that is the same steering ratio for turning the marine craft.

DETAILED DESCRIPTION

Figure 1:
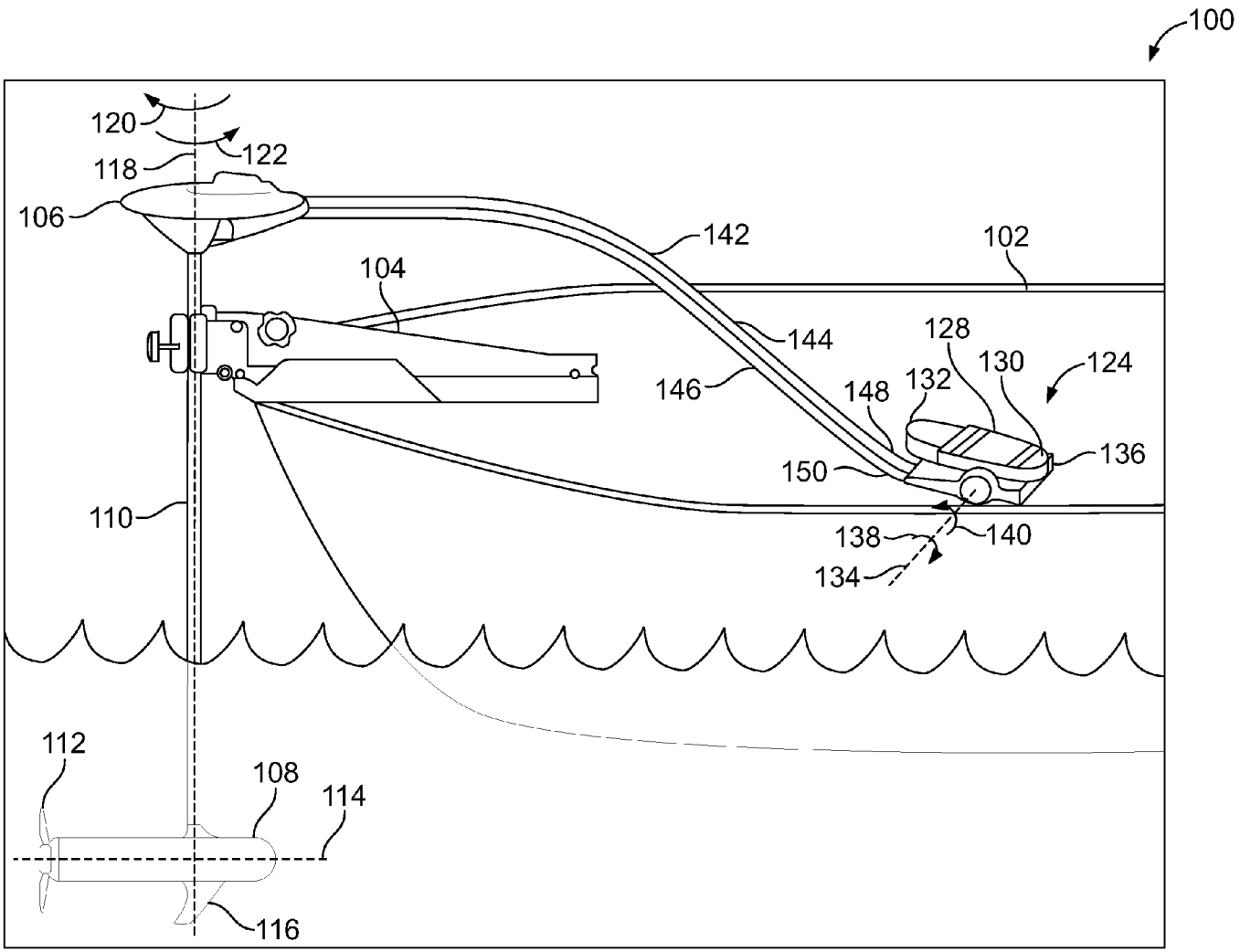
FIG. 1 illustrates an example marine craft having an example steering apparatus constructed in accordance with the teachings disclosed herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Boats and/or other marine crafts often employ propulsion systems to advance and/or steer the marine craft or boat. In some examples, a marine craft may employ a primary propulsion system and secondary propulsion system. Outboard motors, for example, provide a primary propulsion system or power to drive a marine craft. Trolling motors, for example, are often employed as a secondary source of propulsion for marine crafts and/or boats because trolling motors provide less power and/or less speed than other motors (e.g., gasoline-powered motors, outboard motors, etc.). However, trolling motors are relatively quiet compared to primary propulsion systems and, thus, enable marine craft operators to quietly and/or precisely maneuver the marine craft. Because of such characteristics, for example, fishermen often use trolling motors to maneuver marine crafts without alarming nearby prey.

To control the direction of the marine craft, marine crafts often employ a steering drum to rotate or move a propulsion system (e.g., an outboard motor, a trolling motor) at least partially submerged in the water. A controller such as, for example, a tiller, a foot pedal, a wireless controller and/or any other suitable controller may be employed to operate or rotate the steering drum. For example, some known trolling motors employ a pull-pull cable system having a cylindrical steering drum to steer the marine craft via a foot pedal. Steering a marine craft via a foot pedal as opposed to a tiller enables an operator (e.g., a fisherman) to use his or her hands to perform other tasks (e.g., hold a fishing line).

Such known steering drums typically have a uniform shape or profile (e.g., provided a steering drum having a circular cross-sectional shape). For example, the steering drums are typically cylindrically shaped and, thus, have a uniform radius about an entire circumference of the steering drum between a central axis of the steering drum and an outer surface of the steering drum along a length of the drum. Such a uniform shape or profile provides a uniform, constant or non-varying steering ratio. In other words, a specific number of degrees of rotation of a controller (e.g., a foot pedal) corresponds linearly to a specific number of degrees of rotation of the steering drum. For example, a steering ratio between the steering drum and the controller may be configured such that each degree of rotation or movement of a controller causes 6 degrees of rotation of the steering drum (e.g., a 6 to 1 ratio). Such a steering ratio is often needed to turn the marine craft (e.g., to turn the marine craft leftward or rightward). However, although this steering ratio (e.g., a 6 to 1 ratio) enables the marine craft to turn, such a steering ratio (e.g., a 6 to 1 ratio) provides a high steering sensitivity that may make it difficult to make small steering adjustments or corrections in a left or right direction when the marine craft is moving generally forward or in a straight ahead direction.

Example steering apparatus disclosed herein provide a variable or non-uniform steering or turning ratio that provides improved steering accuracy and/or maneuverability. For example, the variable steering ratio apparatus disclosed herein provides a first relatively high on-center steering ratio (i.e., when the marine craft is traveling straight ahead). As the example steering apparatus is moved off-center toward a full-lock condition (i.e., to steer the marine craft fully or hard left or hard right), the steering ratio decreases continuously to reach a second relatively low full lock steering ratio. In this manner, the example steering apparatus disclosed herein can be configured to provide a relatively low steering sensitivity or a high steering accuracy (e.g., a steering ratio of 2 to 1 or a steering ratio less than 6.4 to 1) to enable improved control or steering accuracy (e.g., make small steering adjustments) when a marine craft is traveling in a forward or straight ahead direction. Additionally, the example steering apparatus disclosed herein provides a relatively high steering sensitivity or low steering accuracy (e.g., a steering ratio equal to or greater than 6.4 to 1) when the marine craft is turning (e.g., left or right). Thus, while the steering apparatus disclosed herein yields at least a first steering ratio (e.g., a first range of steering ratios) to provide increased steering accuracy to significantly improve small steering adjustments in the forward or rearward maneuverability of a marine craft, the steering apparatus yields at least a second steering ratio (e.g., a second range of steering ratios) that does not affect or hinder a range or maneuverability (e.g., a turning radius) needed for turning the marine craft.

To provide a non-uniform or varying steering ratio, the example steering apparatus disclosed herein have a non-uniform or oblong cross-section or profile such as, for example, an elliptically-shaped profile, a cam or offset cylindrically-shaped profile, quartile-section, a non-linear arcuate shaped profile and/or any other shape to provide a varying steering ratio based on a given position of a controller. For example, the steering apparatus may be a steering drum having an oblong cross-sectional shape (e.g., an elliptically-shaped steering drum). In this manner, a distance or radius between a center of rotation of the steering apparatus and a tangency of a perimeter or peripheral edge of an outer surface of the steering apparatus varies about a circumference of the outer surface. For example, the distance or radius may increase between a center of rotation and a first portion of the outer surface to yield a lower steering ratio and the distance or radius may decrease between the center of rotation and a second portion of the outer surface to yield a higher steering ratio.

In some examples, the steering apparatus disclosed herein may be operated with a controller and configured to provide a steering ratio that varies continuously so that each degree of rotation of the controller provides a different steering ratio. In some examples, the steering apparatus disclosed herein may employ a cross-sectional shape or profile that provides a first range of steering ratios along a first travel path (e.g., a first range of degrees of rotation) of the controller and a second range of steering ratios along a second travel path (e.g., a second range of degrees of rotation) of the controller.

In some examples disclosed herein, a controller may be coupled to the example steering apparatus via a cable. More specifically, a portion of the cable may be positioned or wrapped around at least a portion of an outer surface of the steering apparatus. Due to the oblong shaped outer surface, the steering apparatus defines or provides a plurality of varying distances or radii between a longitudinal axis of the steering apparatus and an outer edge as the steering apparatus rotates about the longitudinal axis. As a result, the varying distances cause a continuous change in the steering ratio between a rotational angle of the travel path of the controller and a rotational angle of the steering apparatus to provide or define at least a first range of steering ratios and a second range of steering ratios different than the first range of steering ratios.

The example steering apparatus disclosed herein may be implemented with any motor. For example, the example steering apparatus disclosed herein may be implemented with outboard motors, trolling motors, etc. Additionally or alternatively, the example steering apparatus disclosed herein may be employed with any suitable controller such as, for example, a cable-operated controller, a wireless controller, a tiller, a hydraulic or pneumatic controller, an electronic controller, and/or any other controller to control the direction of a marine craft or other motor vehicle.

FIG. 1 illustrates an example motor 100 having an example steering apparatus constructed in accordance with the teachings disclosed herein. The motor 100 of the illustrated example is coupled to a marine craft or boat 102. The motor 100 of the illustrated example is attached to the marine craft 102 via, for example, a mount 100. The motor 104 of the illustrated example includes a transmission unit 106 coupled to a propulsion unit 108 via a shaft 110. The propulsion unit 108 includes a propeller 112 that rotates relative to a longitudinal axis 114 of the propeller 112 to move the marine craft 102 forward or rearward. The propulsion unit 108 of the illustrated example includes a fin 116 that functions as a rudder to facilitate steering of the motor 100 and the marine craft 102. To steer or control the direction of the marine craft 102, the transmission unit 106 rotates or turns the propeller 112 and/or the propulsion unit 108 relative to a longitudinal axis 118 via the shaft 110 when the propulsion unit 108 is submerged in water. The shaft 110 also provides a pathway for wiring (e.g., power or control wires) between the transmission unit 106 and the propulsion unit 108.

To move or rotate the shaft 110, the propulsion unit 108 and/or the propeller 112 in a first direction 120 (e.g., a first rotational direction) and a second direction 122 (e.g., a second rotational direction) about the longitudinal axis 118, the example marine craft 102 of the illustrated example employs a controller 124. The controller 124 may be operatively coupled to the transmission unit 106 via a cable, a wireless connection, or other mechanical and/or electrical control apparatus to enable control of a steering apparatus of the transmission unit 106.

The controller 124 of the illustrated example is a pedal 128 (e.g., a toe-to-heal pedal) having a first pedal portion or end 130 and a second pedal portion or end 132. The pedal 128 of the illustrated example pivots about an axis 134 of a base 136 as force is applied to the first pedal portion 130 (e.g., an end adjacent the operator's toe) or the second pedal portion 132 (e.g., an end adjacent the operator's heel) of the pedal 128. In some examples, a neutral position of the pedal 128 corresponds to when the pedal 128 (e.g., each of the ends 130, 132) is substantially parallel to the base 136 of the pedal 128. Thus, when force is applied to the first pedal portion 130 of the illustrated example, the first pedal portion 130 moves along a first travel path about the pivot axis 134 in a first rotational direction 138. Similarly, when force is applied to the second pedal portion 132, the second pedal portion 132 moves along a second travel path about the pivot axis 134 in a second rotational direction 140 opposite the first rotational direction 138. As the pedal 128 is rotated about the pivot axis 134 in the first rotational direction 138 (e.g., in a manner that moves the first portion 130 closer to the base 136), the propulsion unit 108 and/or the propeller 112 move or rotate in the first direction 120 (e.g., a clockwise direction) about the longitudinal axis 118. As the pedal 128 is rotated about the pivot axis 134 in the second rotational direction 140 (e.g., in a manner that moves the second pedal portion 132 closer to the base 136), the propulsion unit 108 and/or the propeller 112 move or rotate in the second direction 122 about the longitudinal axis 118 (e.g., a counter-clockwise direction).

In this example, the controller 124 or the pedal 128 of the illustrated example is coupled to the transmission unit 106 via a cable 142. More specifically, the controller 124 of the illustrated example employs a first cable 144 and a second cable 146. The first cable 144 has a first portion 148 coupled or attached to the first pedal portion 130 (e.g., the toe portion) and the second cable 146 has a first portion 150 coupled or attached to the second pedal portion 132 (e.g., the heal portion). As a result, movement of the first pedal portion 130 about the pivot axis 134 operates the first cable 144 and movement of the second pedal portion 132 about the pivot axis 134 operates the second cable 146. In other examples, the pedal 128 is operatively coupled to the transmission unit 106 via hydraulics, pneumatics, electronics (e.g., wirelessly), etc. In some examples, the controller 124 may be a hand-operated controller such as, for example, a tiller or control shaft extending from the transmission unit 106 that is rotated about the longitudinal axis 118 to move or rotate the shaft 110, the propulsion unit 108 and/or the propeller 112.

Figure 2:
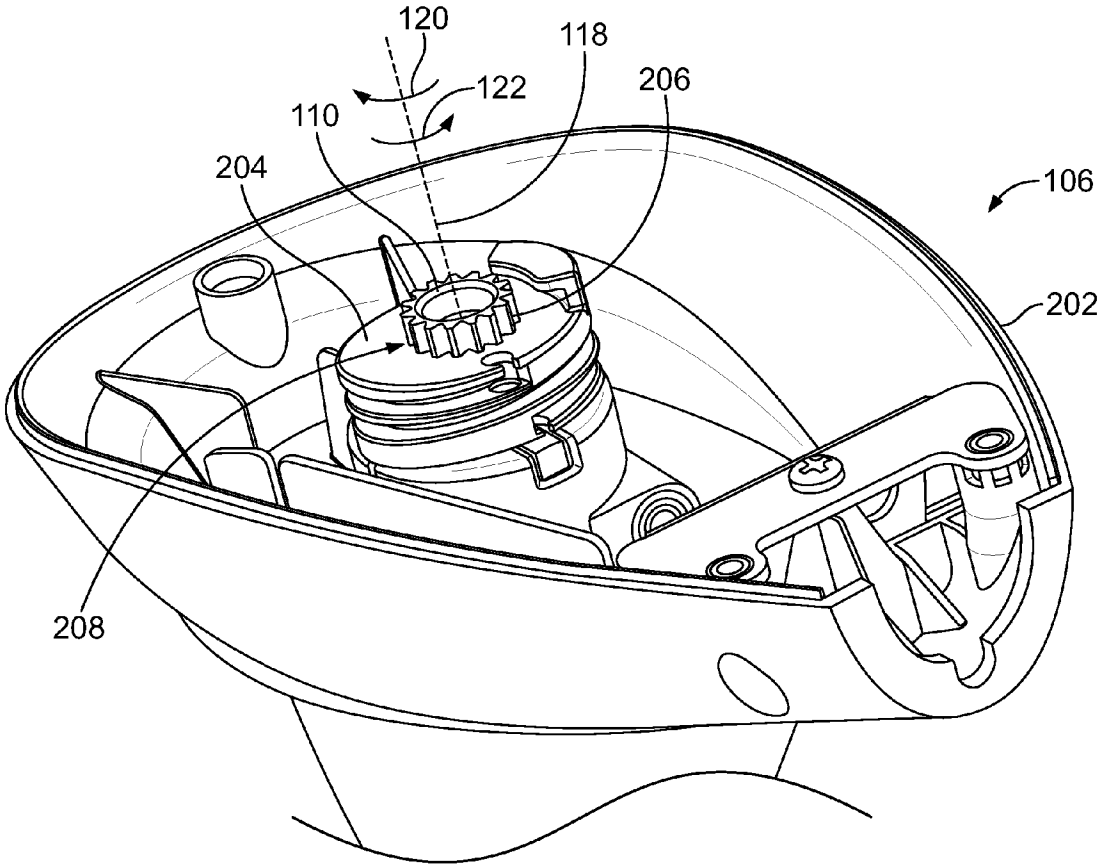
FIG. 2 illustrates is a perspective view of a motor of the example marine craft of FIG. 1 shown without a top cover.

FIG. 2 is a perspective, enlarged view of the example transmission unit 106 of the example motor 100 of FIG. 1, but shown without an upper or top cover. Referring to FIG. 2, the example transmission unit 106 includes a housing or bezel 202 to house a steering apparatus 204 constructed in accordance with the teachings disclosed herein. The steering apparatus 204 is coupled to the shaft 110 such that rotation of the steering apparatus 204 about the longitudinal axis 118 in the first direction 120 causes the shaft 110 to rotate in the first direction 120 and rotation of the steering apparatus 204 about the longitudinal axis 118 in the second direction 122 causes the shaft 110 to rotate in the second direction 122. In the illustrated example, the steering apparatus 204 is coupled or attached to an end 206 of the shaft 110 via a splined connection 208. However, in other examples, the steering apparatus 204 may be coupled or attached to the shaft 110 via a fastener (e.g., screws, pins, bolts, etc.) welding, and/or any other suitable fastener(s) to enable rotation of the shaft 110 in the first and second directions 120, 122 when the steering apparatus 204 rotates in the first and second directions 120, 122, respectively.

Figure 3:
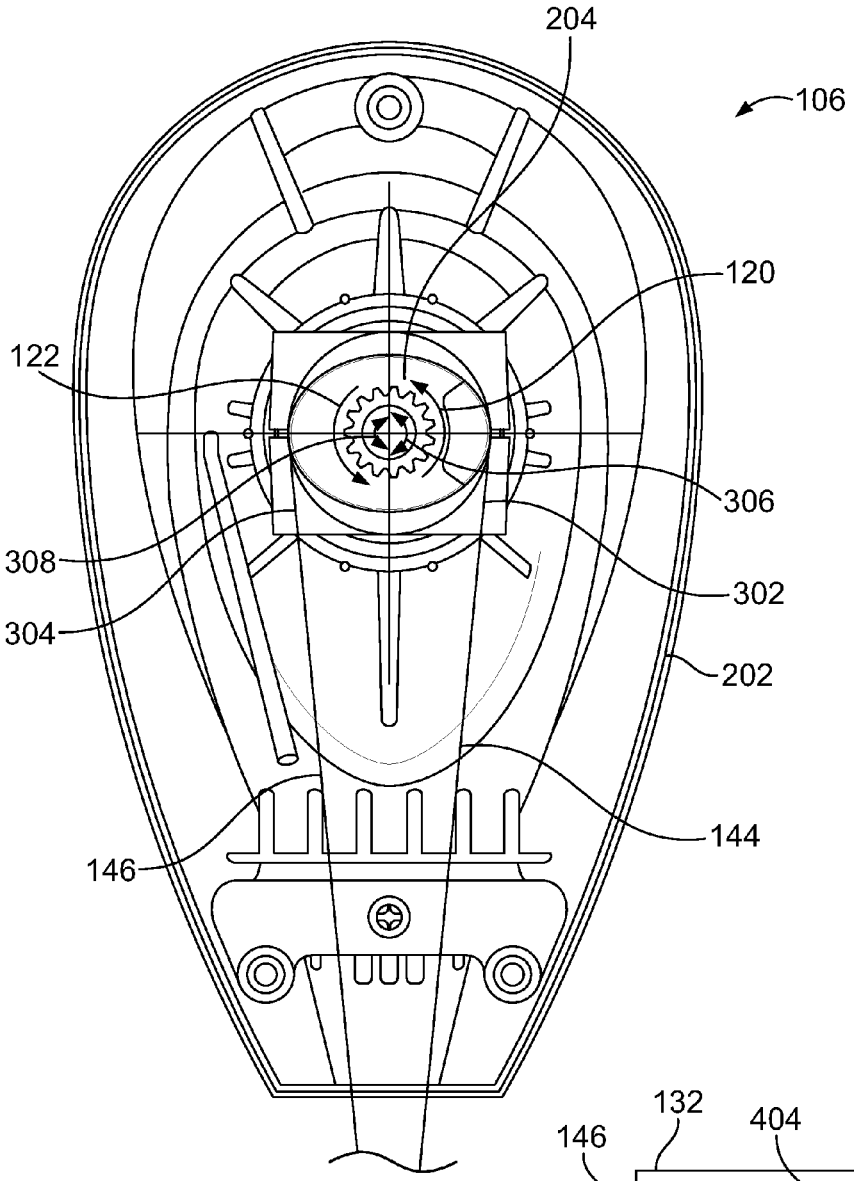
FIG. 3 is a plan view of the example motor shown in FIG. 2.

FIG. 3 is a plan view of the example transmission unit of FIG. 2. To rotate the steering apparatus 204 in the first and second directions 120, 122, a second end 302 of the first cable 144 and a second end 304 of the second cable 146 are coupled or attached to the steering apparatus 204. More specifically, the first cable 144 causes the steering apparatus 204 to rotate in the first direction 120 over a first rotational or angular range 306 (e.g., approximately 180 degrees clockwise). Likewise, the second cable 146 causes the steering apparatus 204 to rotate in the second direction 122 over a second rotational or angular range 308 (e.g., approximately 180 degrees counter-clockwise). In other words, the cables 144, 146 are coupled to the steering apparatus 204 such that when the first pedal portion 130 is depressed toward the base 136 about the pivot axis 134, the steering apparatus 204 rotates in the first direction 120 and when the second pedal portion 132 is depressed toward the base 136 about the pivot axis 134, the steering apparatus 204 rotates in the second direction 122. In operation, the example the steering apparatus 204 of the illustrated example provides a varying steering ratio (e.g., a continuously varying steering ratio) when the steering apparatus 204 is rotated in the first direction 120 over the first rotational range 306 and when the steering apparatus 204 is rotated in the second direction 122 over the second rotational range 308.

Figure 4:
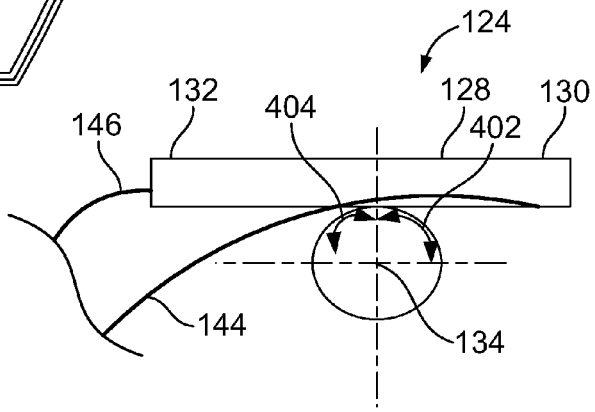
FIG. 4 is a side view of an example controller that may be used to operate the example motor of FIGS. 1-3.

FIG. 4 is side view of the example controller 124 of FIG. 1. Referring to FIGS. 3 and 4, as described in greater detail below, the varying steering ratio varies as the pedal 128 pivots about the axis 134 along a first travel path 402 and a second travel path 404 to provide the varying steering ratio. More specifically, the varying steering ratio is associated with the first rotational range 306 of the steering apparatus 204 and the first travel path 402 of the pedal 128 when the steering apparatus 204 is rotated in the first direction 120. Likewise, the varying steering ratio is also associated with the second rotational range 308 of the steering apparatus 204 and the second travel path 404 of the pedal 128 when the steering apparatus 204 is rotated in the second direction 122.

Figure 5A:
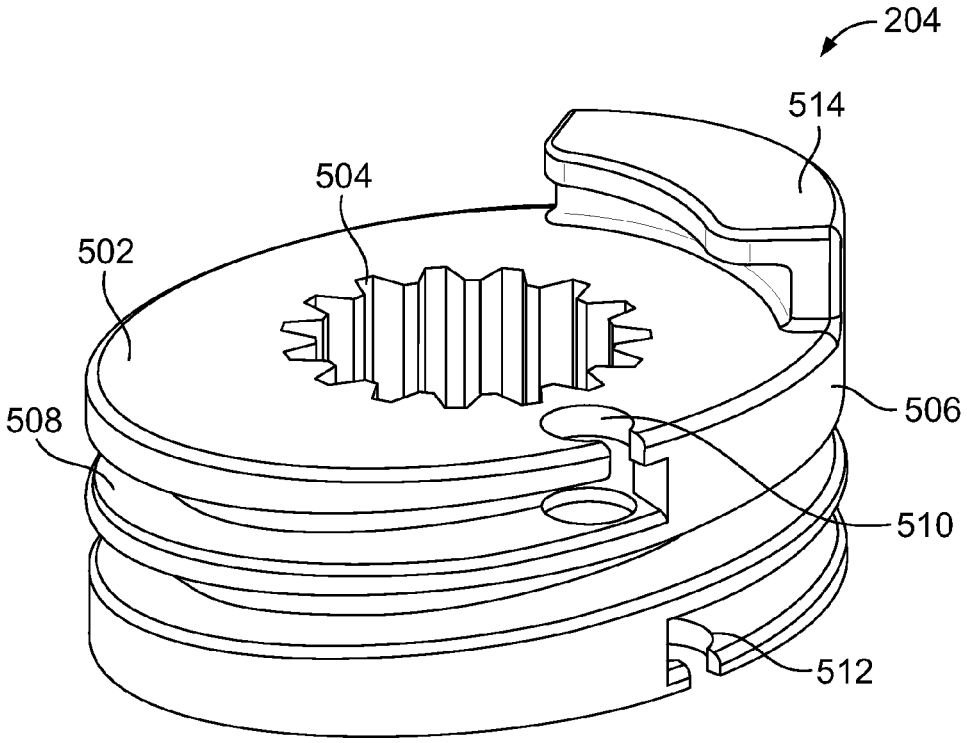
FIG. 5A is a perspective view of the example variable steering apparatus of FIGS. 2 and 3.
Figure 5B:
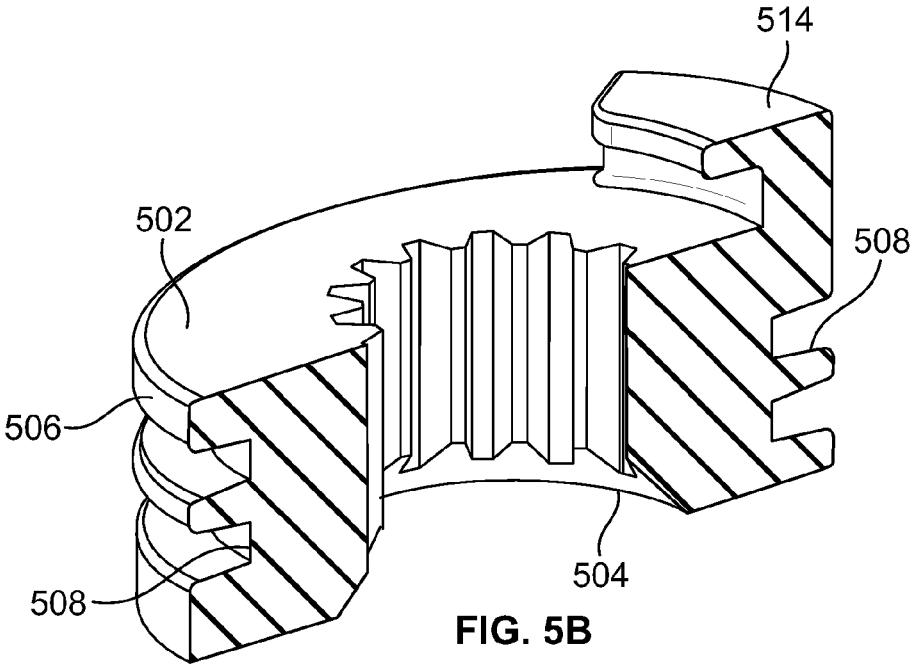
FIG. 5B is a cross-sectional view of the example variable steering apparatus of FIG. 5A.

FIG. 5A is a perspective view of the steering apparatus of FIGS. 2-4. FIG. 5B is a cross-sectional view of the example steering apparatus of FIG. 5A. Referring to FIGS. 5A and 5B, the steering apparatus 204 of the illustrated example is a steering drum or body 502 defining an aperture 504 and an outer surface 506. More specifically, the aperture 504 of the illustrated example is configured to receive the end 206 of the shaft 110. Thus, as shown in this example, the aperture 504 is shaped to be complementary to a shape of the end 206 of the shaft 110. In particular, the aperture 504 of the illustrated example has a spline-shaped profile to matably receive the splined end 206 of the shaft 110. In other examples, the aperture 504 may have a square profile, a D-shaped profile, a keyed profile and/or any other suitable profile or shape to receive the end 206 of the shaft 110. The outer surface 506 of the illustrated example employs a groove or track 508 (e.g., a helical groove or track) to receive the cables 144, 146. The outer surface 506 also includes a first coupling or opening 510 to receive the second end 310 of the first cable 144 and a second coupling or opening 512 to receive the second end 312 of the second cable 146. Additionally, the steering apparatus 204 of the illustrated example includes a protrusion 514 to attach to a position indicator (e.g., a visual indicator) of the transmission unit 106. The position indicator provides an indication of a rotational position of the steering apparatus 204 when the shaft 110 rotates in the first and second directions 120, 122.

Figure 6A:
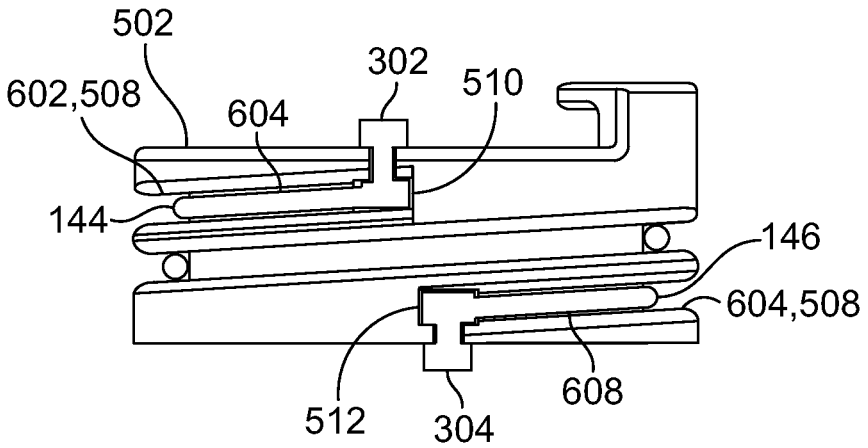
FIG. 6A is a right side view of the example variable steering apparatus of FIGS. 2, 3, 5A and 5B shown with a cable coupled thereto.
Figure 6B:
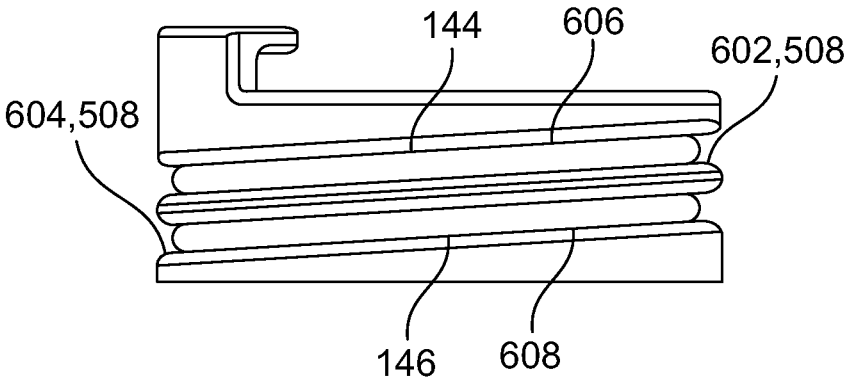
FIG. 6B is a left side view of the example variable steering apparatus of FIGS. 2, 3, 5A and 5B shown with the cable coupled thereto.

FIG. 6A is a left side view of the example steering apparatus 204 of FIGS. 2-4 5A and FIG. 5B. FIG. 6B is a right side view of the example steering apparatus 204 of FIGS. 2-4, 5A, 5B and 6A. The steering apparatus 204 of FIGS. 6A and 6B is shown having the cables 144, 146 coupled thereto. Referring to FIGS. 6A and 6B, the first cable 144 is positioned or received by a first portion 602 of the groove 508 and the second cable 146 is positioned or received in a second portion 604 of the groove 508. More specifically, the second end 302 of the first cable 144 is attached to the first coupling 510 defined by the body 502 and a portion 606 of the first cable 144 is wound about the outer surface 506 within the first portion 602 of the groove 508. Similarly, the second end 312 of the second cable 146 is attached to the second coupling 512 defined by the body 502 and a portion 608 of the second cable 146 is wound the outer surface 506 within the second portion 604 of the groove 508.

Figure 7:
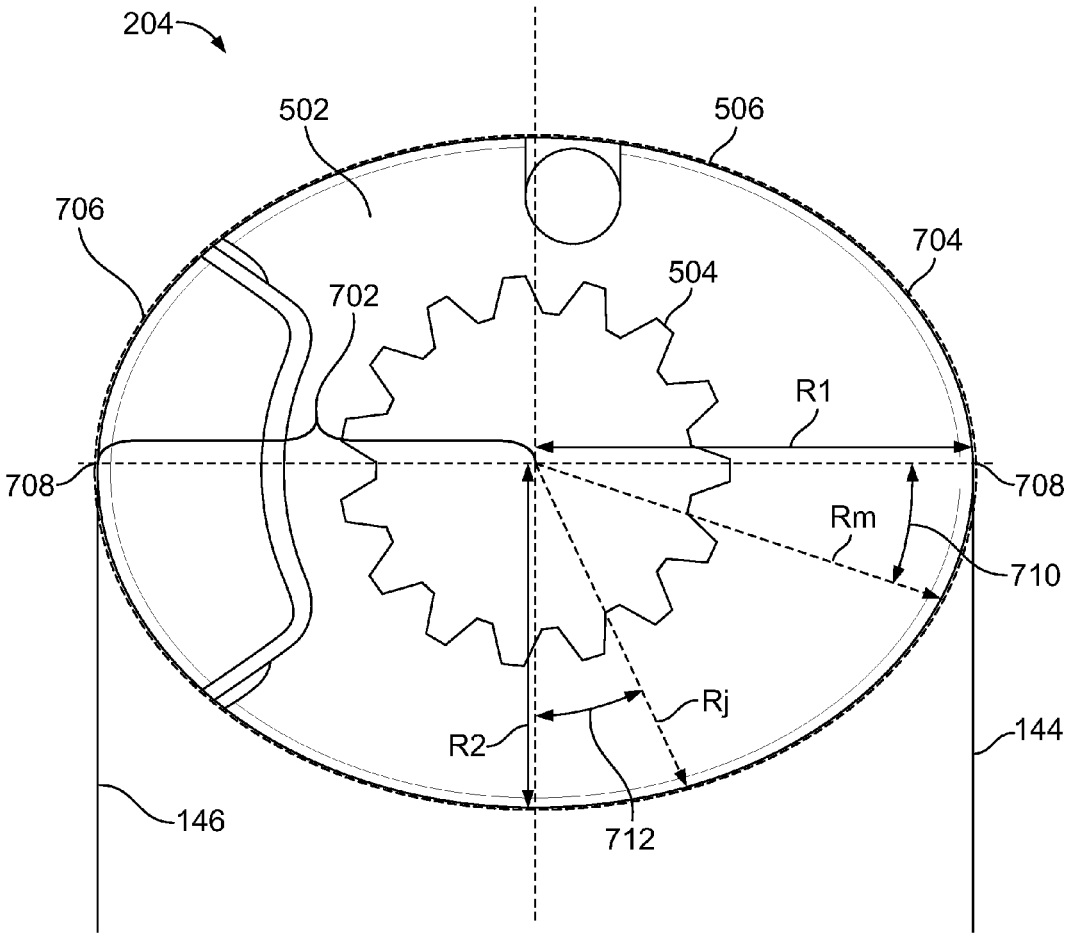
FIG. 7 is a plan view of the example variable steering apparatus of FIGS. 2, 3, 5A, 5B, 6A and 6B.

FIG. 7 is a plan view of the example steering apparatus 204 of FIGS. 2-4, 5A, 5B, 6A and 6B. As shown in FIG. 7, the steering apparatus 204 defines a distance or radius 702 between the longitudinal axis 118 of the aperture 504 and a peripheral edge 704 of the outer surface 506. More specifically, due to the oblong-shaped outer surface 506, the distance 702 varies about a circumference 706 of the outer surface 506 defined by radii (e.g., radius Rj, radius Rm) that vary between a first radius R1 (e.g., a maximum radius) and a second radius R2 (e.g., a minimum radius). More specifically, as the steering apparatus 204 rotates in the first and second directions 120, 122 (FIG. 1), the distance 702 varies between the longitudinal axis 118 and a portion 708 of each of the respective first and the second cables 144, 146 that is positioned in a substantially tangential orientation relative to the peripheral edge 704 of the outer surface 506. As a result, the distance 702 between the longitudinal axis 118 and the tangential portion 708 of the first cable 144 varies between the first and second rotational ranges 306, 308 with respect to the rotation of the pedal 128 to define the varying steering ratio. The varying distance 702 causes a change (e.g., a continuous change) in the steering ratio as the steering apparatus 204 rotates about the longitudinal axis 118.

Further, the steering ratio varies continuously between a first steering ratio defined by radius R1 and a second steering ratio defined by radius R2 (e.g., Rj, Rm). Additionally or alternatively, the varying steering ratio varies progressively (e.g., non-linearly) between the first radius R1 and the second radius R2. As a result, due to the shape of the example steering apparatus 204 (i.e., the radius Rm being closer in length to the radius R1 than the radius Rj), the example steering apparatus 204 provides a first range 710 of varying steering ratios associated with a first portion of the rotational range 306 and a second range 712 of varying steering ratios associated with a second portion of the rotational range 306. In this manner, the first range 710 of steering ratios (e.g., a range between radius R1 and radius Rm) associated with the first portion of the rotational range 306 provides relatively high accuracy steering ratios and the second range 712 of steering ratios (e.g., a range between radius Rj and radius R2) associated with the second portion of the rotational range 306 provides relatively lower accuracy steering ratios.

Figure 8:
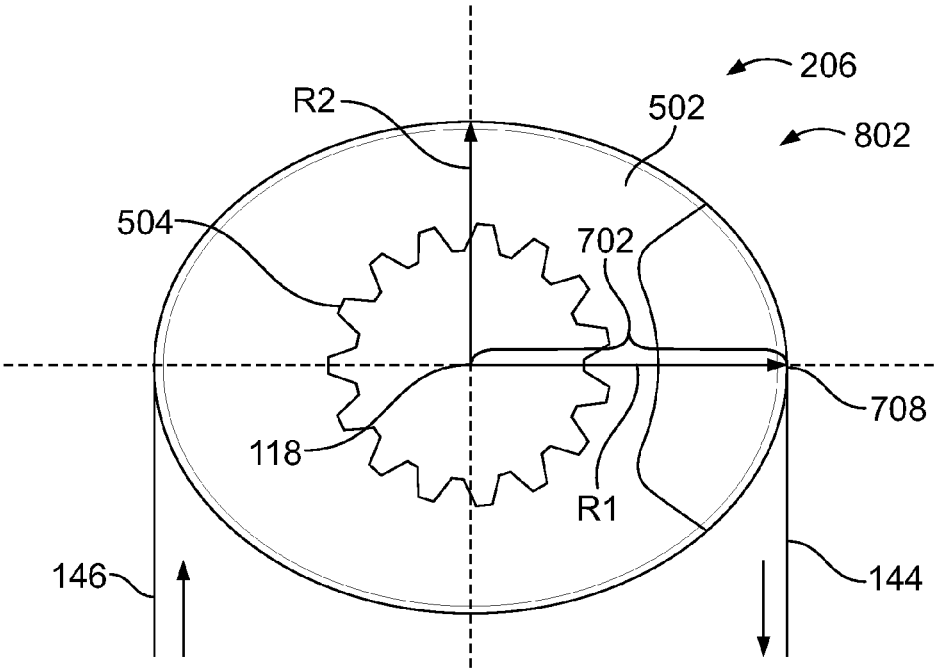
FIG. 8 is a plan view of the example variable steering apparatus of FIGS. 2, 3, 5A, 5B, 6A and 6B positioned to provide a first steering ratio.

FIG. 8 illustrates the steering apparatus 204 of the illustrated example positioned to provide a first steering ratio 802. In the illustrated example of FIG. 8, the distance 702 (i.e., the distance between the longitudinal axis 118 and the tangential portion 708 of the first cable 144) is defined by the radius R1. The first steering ratio 802 of the illustrated example provides a relatively low sensitivity or greater accuracy when steering the marine craft 102 in a generally forward or rearward direction. Further, the distance 702 of the illustrated example varies progressively (e.g., decreases non-linearly) between radius R1 and radius R2. Thus, when steering the marine craft 102 in a generally forward or rearward direction, the first steering ratio 802 provides a relatively greater steering accuracy compared to a second steering ratio defined by radius R2. In the illustrated example, the first steering ratio 802 is provided by a rotational position or angle of the first travel path 402 and a rotational position of the steering apparatus 204 defined by the distance 702 associated with the first radius R1. For example, because the distance 702 associated with the radius R1 and the tangent portion 708 is greater than the distance 702 associated with the radius R2 and the tangent portion 708, a smaller amount of rotation of the controller 124 about the pivot axis 134 causes a smaller amount of rotation of the steering apparatus 204 in the rotational range 306. In contrast, the same rotational amount of rotation of the controller 124 about the pivot axis 134 causes a larger amount of rotation of the steering apparatus 204 when the distance 702 is associated with radius R2. Thus, the example steering apparatus 702 provides at least the first steering ratio 802 that is different than a second steering ratio.

Figure 9:
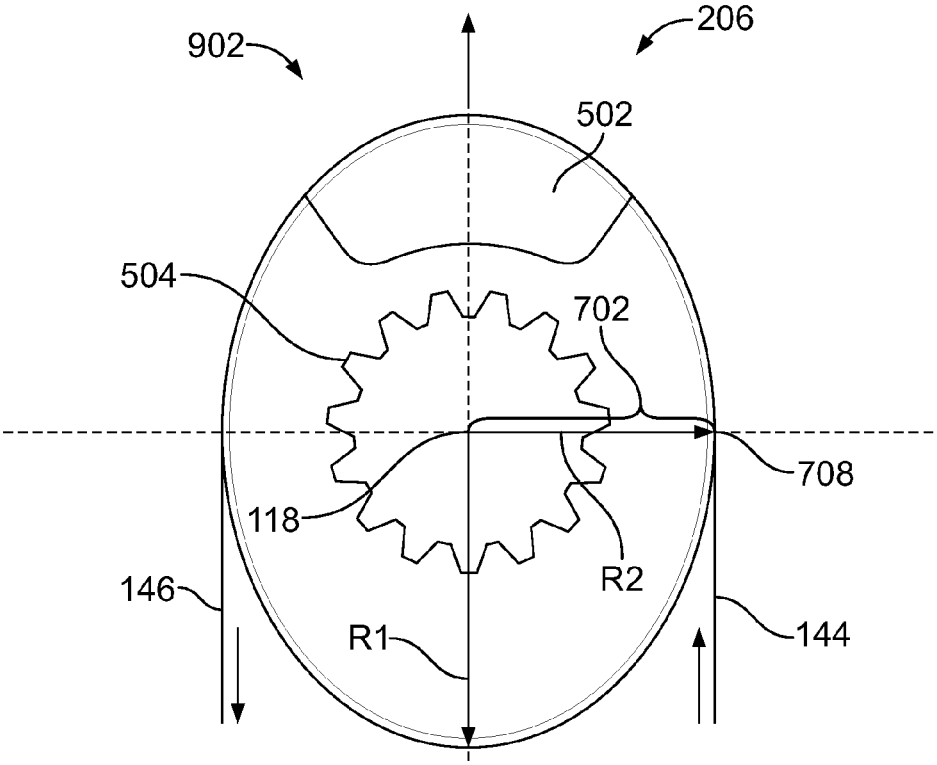
FIG. 9 is a plan view of the example variable steering apparatus of FIGS. 2, 3, 5A, 5B, 6A and 6B positioned to provide a second steering ratio.

FIG. 9 illustrates the steering apparatus 204 of the illustrated example positioned to provide a second steering ratio 902. In the illustrated example of FIG. 9, the distance 702 is defined by the radius R2. As a result, the second steering ratio 902 provides a greater sensitivity or lower accuracy when steering or turning the marine craft 102 compared to the steering ratio 802. Thus, when turning the marine craft 102, the second steering ratio 902 provides greater sensitivity to provide a smaller turning radius of the marine craft 102. In other words, by providing a greater steering accuracy via the first steering ratio 802 when moving in a generally forward or rearward direction, the steering sensitivity is not compromised when turning the marine craft 102 due to the second steering ratio 902.

Thus, the example steering apparatus 204 disclosed herein provides a varying steering ratio defined by the rotation of the steering apparatus 204 (e.g., degree rotation) over the controller 124 rotation (e.g., degree rotation) about the pivot axis 134 and based on the varying distance 702 between the longitudinal axis 118 and the tangential portion 708. For example, the first steering ratio 802 may be for example, 1 to 1, 2 to 1, 3 to 1, 4 to 1, and/or any other steering ratio less than the second steering ratio 902. A steering ratio of 2 to 1, for example, causes the steering apparatus 204 to rotate 2 degrees about the longitudinal axis 118 for every degree of rotation of the first pedal portion 130 along the first travel path 402. Similarly, the second steering ratio 902, for example, may be approximately 6.4 to 1. Therefore, for every degree of rotation of the first pedal 130 in the first travel path 402 (e.g., the second portion 402*b*), the steering apparatus 204 rotates 6.4 degrees about the longitudinal axis 118. Further, the varying steering ratio continuously varies between the first radius R1 and the second radius R2 to provide a relatively smooth transition between the first steering ratio 802 and the second steering ratio 902.

Figure 10:
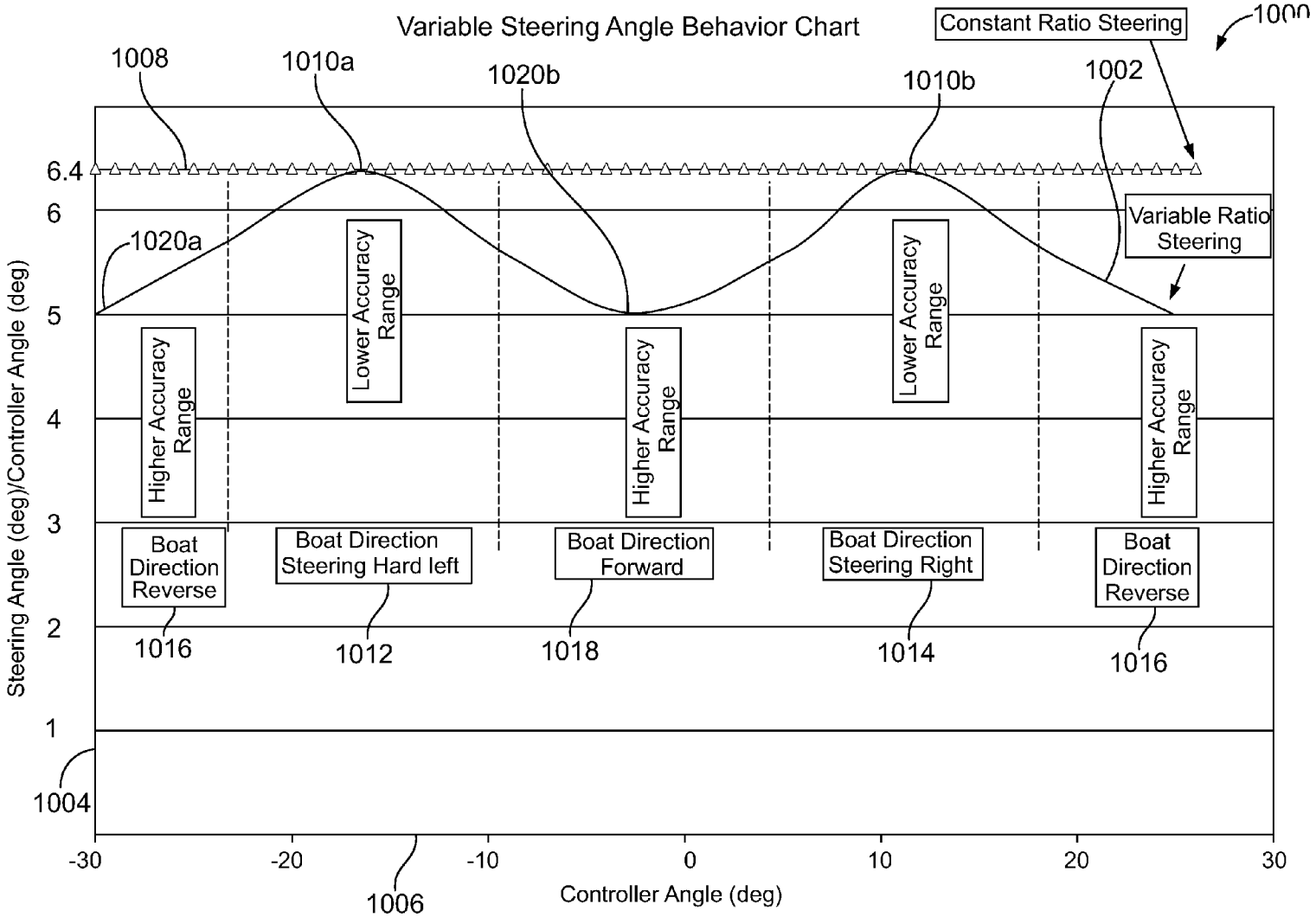
FIG. 10 is graph illustrating example steering ratios of an example variable steering apparatus disclosed herein.

FIG. 10 is a graph 1000 illustrating example steering ratios 1002 of the example variable steering apparatus 204 disclosed herein. The example graph 1000 shows the steering ratios 1002 provided by the ratio value 1004 (e.g., along the y-axis) over a rotational position 1006 of the controller 124 (e.g., along the x-axis). The graph 1000 also illustrates a constant steering ratio 1008 (e.g., 6.4 to 1) typically provided by a known steering apparatus. For example, the known steering apparatus provides a constant steering ratio over the entire rotational range of the controller 124. As illustrated in the graph 1000, the steering apparatus 204 provides a steering ratio 1010*a*, 1010*b* that approaches or is substantially equivalent to the constant steering ratio 1008 (e.g., provided by the known steering apparatus) when the example variable steering apparatus 204 is steering hard left 1012 (e.g., a controller angle of between approximately −10 and −25 degrees) or hard right 1014 (e.g., a controller angle of between approximately 5 and 20 degrees). However, when the marine craft 102 is moving in a reverse direction 1016 or a forward direction 1018, the variable steering apparatus 204 provides a steering ratio 1020*a*, 1020*b* that is greater than the constant steering ratio 1008 and/or the steering ratio 1010*a*, 1010*b*. As a result, the steering ratio 1018*a*, 1018*b* provides a greater steering accuracy compared to the steering ratio 1010*a*, 1010*b*.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a steering drum having an oblong shaped cross section and a helical groove; and a cable wrapped around only a portion of an outer surface of the steering drum in the helical groove, the portion of the outer surface less than a perimeter of the steering drum.

2. The apparatus as defined in claim 1 further comprising a controller of a marine craft operatively coupled to the cable to cause the steering drum to rotate.

3. The apparatus as defined in claim 2, wherein moving the controller along a first travel path rotates the steering drum in a first direction and moving the controller along a second travel path rotates the steering drum in a second direction.

4. The apparatus as defined in claim 1 further comprising a shaft having a first end disposed through an aperture of the steering drum.

5. The apparatus as defined in claim 4, wherein the aperture of the steering drum has a profile to receive the first end of the shaft having a corresponding profile.

6. The apparatus as defined in claim 4, wherein the first end of the shaft is coupled to the steering drum via a fastener.

7. The apparatus as defined in claim 4 further comprising a marine propulsion unit having a fin to steer a marine craft operatively coupled to a second end of the shaft to rotate as the steering drum rotates.

8. The apparatus as defined in claim 1 wherein the oblong shaped cross section provides a continuously varying steering ratio.

9. The apparatus as defined in claim 1 wherein rotating the steering drum a first amount corresponds to a first steering ratio and rotating the steering drum a second amount corresponds to a second steering ratio different than the first steering ratio.

10. The apparatus as defined in claim 1 further comprising a visual position indicator to indicate a rotational position of the steering drum.

11. The apparatus as defined in claim 3, wherein the first travel path includes a first angular range less than one revolution of the steering drum and the second travel path includes a second angular range less than one revolution of the steering drum.

12. The apparatus as defined in claim 1, wherein the steering drum includes an opening adjacent the helical groove to receive the cable.

13. An apparatus comprising:

a steering drum having a helical groove and a lateral cross-sectional shape to provide a varying steering ratio;

a first cable wound around only a first portion of the helical groove to rotate the drum in a first direction, the first portion less than a perimeter of the steering drum; and a second cable wound around only a second portion of the helical groove to rotate the drum in a second direction, the second portion less than the perimeter of the steering drum.

14. The apparatus as defined in claim 13, wherein a first end of the first cable and a first end of the second cable are coupled to the steering drum.

15. The apparatus as defined in claim 13, wherein a second end of the first cable and a second end of the second cable are coupled to a pedal to control a degree of rotation and a direction of rotation of the steering drum.

16. The apparatus as defined in claim 15 further comprising a propulsion unit operatively coupled to the steering drum to steer a marine craft in response to the rotation of the steering drum, wherein the varying steering ratio causes an angle at which the marine craft turns to vary continuously relative to an angle of rotation of the pedal.

17. The apparatus as defined in claim 16, further comprising a shaft having a first end disposed through an aperture of the steering drum and a second end to operatively couple to the propulsion unit.

18. An apparatus comprising:

means for providing a variable steering ratio having a helical groove; and means for rotating the means for providing the variable steering ratio, the means for rotating wrapped around only a portion of a perimeter of the means for providing the variable steering ratio in the helical groove and having a first end and a second end, the first end distal to the second end.

19. The apparatus as defined in claim 18 further comprising means for controlling the means for rotating, wherein moving the means for controlling in a first direction causes the means for rotating to rotate the means for providing the variable steering ratio in a first direction and moving the means for controlling in a second direction causes the means for rotating to rotate the means for providing the variable steering ratio in a second direction.

20. The apparatus as defined in claim 18 further comprising means for receiving the means for rotating, the means for receiving disposed on a surface of the means for providing the variable steering ratio.

21. The apparatus as defined in claim 18 further comprising means for steering a marine craft operatively coupled to the means for providing the variable steering ratio, the means for steering to rotate with the means for providing the variable steering ratio.

* * * * *